US007021373B2

(12) United States Patent
Hardgrave

(10) Patent No.: US 7,021,373 B2
(45) Date of Patent: Apr. 4, 2006

(54) DOWNHOLE HYDRAULIC RAM

(76) Inventor: William David Hardgrave, 1933 Westminster, Carrollton, TX (US) 75007

( * ) Notice: Subject to any disclaimer, the term of this patent is extended or adjusted under 35 U.S.C. 154(b) by 229 days.

(21) Appl. No.: 10/632,448

(22) Filed: Aug. 1, 2003

(65) Prior Publication Data

US 2005/0022997 A1 Feb. 3, 2005

(51) Int. Cl.
*E21B 43/00* (2006.01)

(52) U.S. Cl. ..... 166/68; 166/54.1; 166/69; 417/120

(58) Field of Classification Search ..... 166/54.1, 166/68, 69; 417/120, 126, 134, 138, 307, 417/226, 65
See application file for complete search history.

(56) References Cited

U.S. PATENT DOCUMENTS 1,859,394 A * 5/1932 Holladay ..... 417/260
2,887,956 A * 5/1959 Kunkel ..... 417/148
6,224,344 B1 * 5/2001 Hasbrouck ..... 417/120
6,234,764 B1 * 5/2001 Obermoser ..... 417/226

FOREIGN PATENT DOCUMENTS

GB 2336183 * 10/1999

* cited by examiner

*Primary Examiner*—Frank S. Tsay

(57) ABSTRACT

A system and method for pumping water from a wellbore to a surface location using an improved motorless water pump. The improved motorless water pump is a downhole hydraulic ram pump powered by the renewable energy source, groundwater. As water falls down a wellbore from an upper strata to a lower strata, the conversion of the water's momentum to energy is used to compress air captured in the ram's pressure chamber. The compressed air contained in the pressure chamber pushes down on the water captured in the pressure chamber causing the water to exit the pressure chamber through an outlet and into tubing. The water in the tubing is responsive to the pressure in the chamber rising to the surface.

32 Claims, 8 Drawing Sheets

DOWNHOLE HYDRAULIC RAM

RELATED APPLICATIONS

Figure 1A:
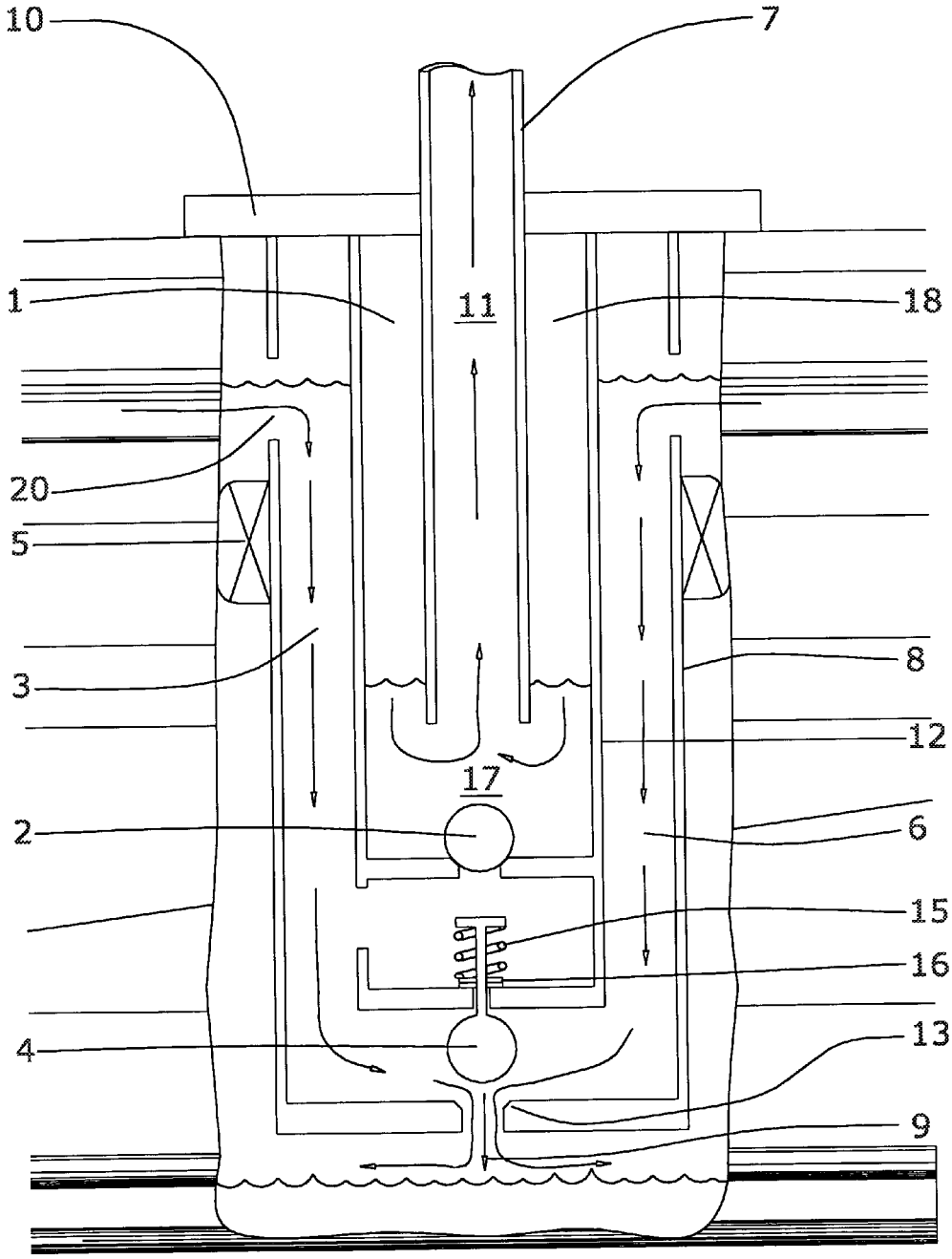

This Application is related to, and claims the benefit of the filing dates of U.S. Provisional Patent Application No. 60/324,026, filed Sep. 24, 2001, and U.S. Provisional Patent Application No. 60/345,566, filed Jan. 7, 2002, all of which are incorporated herein by reference.

TECHNICAL FIELD OF THE INVENTION

It is an object of this invention to provide an improved motorless water pump. It is a further object of this invention to provide a motorless pump utilizing fluid flow and momentum thereof to lift the fluid to a higher location. It is an object of this invention to provide a motorless pump to lift water from a wellbore to a higher ground elevation for storage and use.

BACKGROUND OF THE INVENTION

The well-known hydraulic ram pump originated in 1772 when J. Whitehurst theoretically invented the concept. Not until 1797 was the idea filly developed and patented by J. M. de Montgolfier. The Montgolfier invention could lift water to a high altitude using the energy created from the momentum of a larger amount of water falling only a few feet. Prof. J. A. Eytelwein of Berlin first described the basic design principles of the hydraulic ram pump in 1805. The design of the single acting hydraulic ram pump has never been developed fully because of the inability of designers to forecast the performance of the machine. Because of its limited use, it has not received the attention from designers that its usefulness, simplicity and inexpensiveness demand. Its use is mostly confined to small sizes, and it is still considered by many merely as a scientific novelty suitable for pumping only small amounts where efficiency is not of great importance. There are many cases where a hydraulic ram pump could be employed for lifting water with a very material savings were its action better understood. There is a need to develop a method and equipment to pump water from a wellbore without the assistance of electrical power for submersible pumping or the well-known windmill and hand pump. The development of this pumping system would be especially useful by improving the quality of life in developing countries. This invention, the downhole hydraulic ram pump, is used to lift water from a water wellbore.

Over the years, various apparatus have been developed in the United States for motorless pumping; for example, the early device was described by Frank B. Hanson in U.S. Pat. No. 422,936 entitled "Hydraulic Ram", dated Mar. 11, 1890. Other hydraulic ram pumps are presented in U.S. Pat. No. 715,167, dated Dec. 2, 1902 and U.S. Pat. No. 753,560, dated Mar. 1, 1904, both entitled "Hydraulic Ram." Alfred H. Francfort developed two apparatus U.S. Pat. No. 845,402 and U.S. Pat. No. 2,309,058 entitled "Hydraulic Ram" constructed where the impulse valve and air chamber connector are arranged in vertical alignment. In yet another U.S. Pat. No. 992,524 entitled "Hydraulic Ram", dated May 16, 1911, George W. Walters developed an apparatus to improve the impact valve by providing a pendulum mechanism adapted to quickly open and close the valve. Hill et al. in U.S. Pat. No. 1,016,409 entitled "Hydraulic Ram", dated Feb. 6, 1912 provided a check valve mechanism where the least amount of resistance is offered to the water passing the valve. Nicholas, in U.S. Pat. No. 1,148,982 entitled "Hydraulic Ram", dated Aug. 3, 1915 provided a maintenance inlet valve. Larry A. Cox in U.S. Pat. No. 4,911,613 entitled "Hydraulic ram-type water pump", dated Mar. 27, 1990, presented the newest technology available in the ram pump industry.

The well-known hydraulic ram pump, hereafter referred to as a ram, was in use in the United States during the later 1800's and early 1900's. As demonstrated by the cited U.S. patents during this period, the design and manufacturing of the ram pump made its greatest advances. The surge of interest was due to the absence of electrical power throughout the country and a need to pump water. Installations consisted of common elements for proper function of the ram. There was always a drive pipe, sometimes referred to as a supply pipe, feeding the ram and a reservoir or stream at an elevation above the ram feeding into the drive pipe. The drive pipe usually was installed following the general contour of the ground sloping downward to the ram. Through the drive pipe, the water would flow downward enabling the ram's operation. The water would exit the ram through an impulse valve, sometimes called a waste valve, usually located on the topside of the ram. The water flow would continue until the impulse valve closed. The pressure surge that followed suddenly stopping the flowing water would open a check valve located at the base of the ram's air or pressure chamber, hereafter referred to as a chamber. Water with air would be rammed into the chamber compressing the air trapped in the upper end of the chamber. As the surge pressure dissipated, the check valve would close capturing the water and compressed air in the chamber. A delivery pipe was positioned where the water in the lower end of the chamber always covered the exit point from the chamber and the delivery pipe's entry point. Water under pressure in the chamber would exit the chamber flowing through the delivery pipe. The pressure in the chamber would cause the water to exit, flowing into the delivery pipe lifting the water to a higher elevation. An air makeup valve located outside the chamber and just below the check valve permitted small amounts of air to be admitted into the system to ensure that air was in the pressure chamber at all times, an important element for proper operation of the ram. Gallons of water have been successfully pumped from rivers, springs, and streams using the ram. No successful effort has been made to use the ram to pump water from a wellbore until this invention. The invention provides a new motorless pump system, method and apparatus to pump water from a water wellbore to a surface elevation for storage and use.

SUMMARY OF THE INVENTION

The invention uses the renewable energy source, groundwater, to power the invention's new hydraulic ram pump configuration. Naturally occurring groundwater can be found in multiple aquifers distributed throughout a subsurface groundwater zone. Each aquifer can have multiple strata. The natural placement of each strata relative to other strata creates an environment of potential energy. If a conduit such as a wellbore is drilled to intersect the stratum (multiple strata) or aquifers in a groundwater zone, under normal conditions water would fall from upper water strata to lower strata or void formation that would accept water; the resulting energy developed could be used to do work. The upper water strata would serve as the supply and a lower formation or strata would serve as the receiving strata or stratum. The supply flow rate of the source water strata or stratum and the receiving flow rate of the lower strata or stratum will determine the amount of work produced. The lower strata's hydraulic pressure required for flow will determine the effective distance between the stratum available for work. The required hydraulic pressure to achieve the desired flow rate in the lower strata or stratum could be higher than expected causing the water to rise in the well bore and decrease the effective distance. The distance between the lower water strata's free surface in the wellbore and the supply strata measured along a vertical intersecting wellbore is the effective distance or maximum hydraulic head that can be made available to operate the invention pump. An additional factor that determines the pumping capability of the invention pump is what depth the environment for potential energy is found beneath the earth's surface. If the involved stratum are found deep in the wellbore the water will have to be pumped from a deeper depth to the surface resulting in a lesser volume of water pumped to the surface.

Special attention should be given to the stratum or aquifers scheduled for use. The commingling of two strata of the same aquifer should not be a problem. The commingling of two aquifers should always improve or not appreciably change the water quality of the lower aquifer. The pump is designed to deliver the upper aquifer water to the surface. In drilling a water wellbore to a lower aquifer, one could encounter a rise in the water level of the aquifer after encountering the strata. The rise of the water level is evidence of the hydraulic head required to cause the aquifer to flow at that particular location. The installation of the pump will need to be above the lower strata's free water surface in the wellbore to avoid a high pump backpressure.

When undesirable water or constituents such as hydrocarbons are encountered in the upper aquifer, a wellbore should not be completed. If both aquifers are equally undesirable the purpose of the well must be questioned. Care must be taken to not contaminate the earth's surface. For example, salt water is not normally useful for agrarian activities and detrimental to crop growing; therefore, salt water would not be pumped to the surface for this operation. Normally a wellbore should not be completed in this case.

Where the upper aquifer is of good quality and the lower aquifer is undesirable or less desirable, the wellbore can be completed. The pump must be positioned above the lower aquifer's free water surface in the wellbore where there is minimal backpressure on the pump. Care must be taken to prevent waters from the lower aquifer entering the pressure chamber. Commingling the two aquifers will improve the lower aquifer water quality. The improved water quality could enable its use downstream.

When both aquifers are of good quality the wellbore should be completed. Where the lower aquifer water quality is better than the upper, consideration should be given to commingling the two aquifers. The question, Is the risk worth the gain, should be addressed. Based on the risk evaluation the wellbore should or should not be completed.

The downhole hydraulic ram pump should be used in locations where the subterranean water resources provide sufficient effective distance, hydraulic head, to pump water from approximately the receiving strata elevation to the surface elevation in desirable quantities. An alternative location would be an improvement where a cement dyke is created by pumping cement into multiple borings spanning across an underground stream to retain the flowing water in the same way a dam retains a river and thereby creating a differential in the underground water levels. Once the location is chosen or developed, a wellbore is drilled to convey the water from an upper supply elevation behind the dyke to a lower receiving elevation at the foot of the dyke. The strata on the down-stream side of the dyke will be able to receive the flow from above the dyke because the flow had been there before. The completion will locate the ram pump's upper and lower valving means, hereafter referred to as valving means, nearer the lower receiving level than the upper supply level; this will allow the ram to operate using the created differential between the water levels. This differential can occur at any depth in the wellbore, provided sufficient energy could be generated by falling water between the two levels to pump the desired amount of water from the valving means location to the earth's surface.

The hydraulic ram or impulse pump is a device that employs the energy of the falling drive water to lift a lesser amount of delivery water higher than the source elevation. There are only two moving parts, thus minimizing the maintenance. For these reasons the hydraulic ram pump is an attractive solution where upper water strata or stratum have a large flow rate and a lower strata or stratum have the ability to receive the water are found to exist. As a rule, a hydraulic ram pump should be considered when there is a water source, free of sand, which can provide at least seven (7) times more water than the ram pump is to deliver to the surface. The following are the design factors to be considered for the successful operation of the ram pump:

The distance between water source and the pump elevation (vertical fall H)

The distance between pump elevation and the earth's surface elevation (lift L)

The sustainable flow rate available from the source (supply)

The length of annulus from the source to the pump (drive pipe)

The length of pipe from the pump to the earth's surface (delivery pipe)

The receiving strata's ability to receive discharged water at a sustainable rate

DETAILED DESCRIPTION OF THE DRAWINGS

Figure 1B:
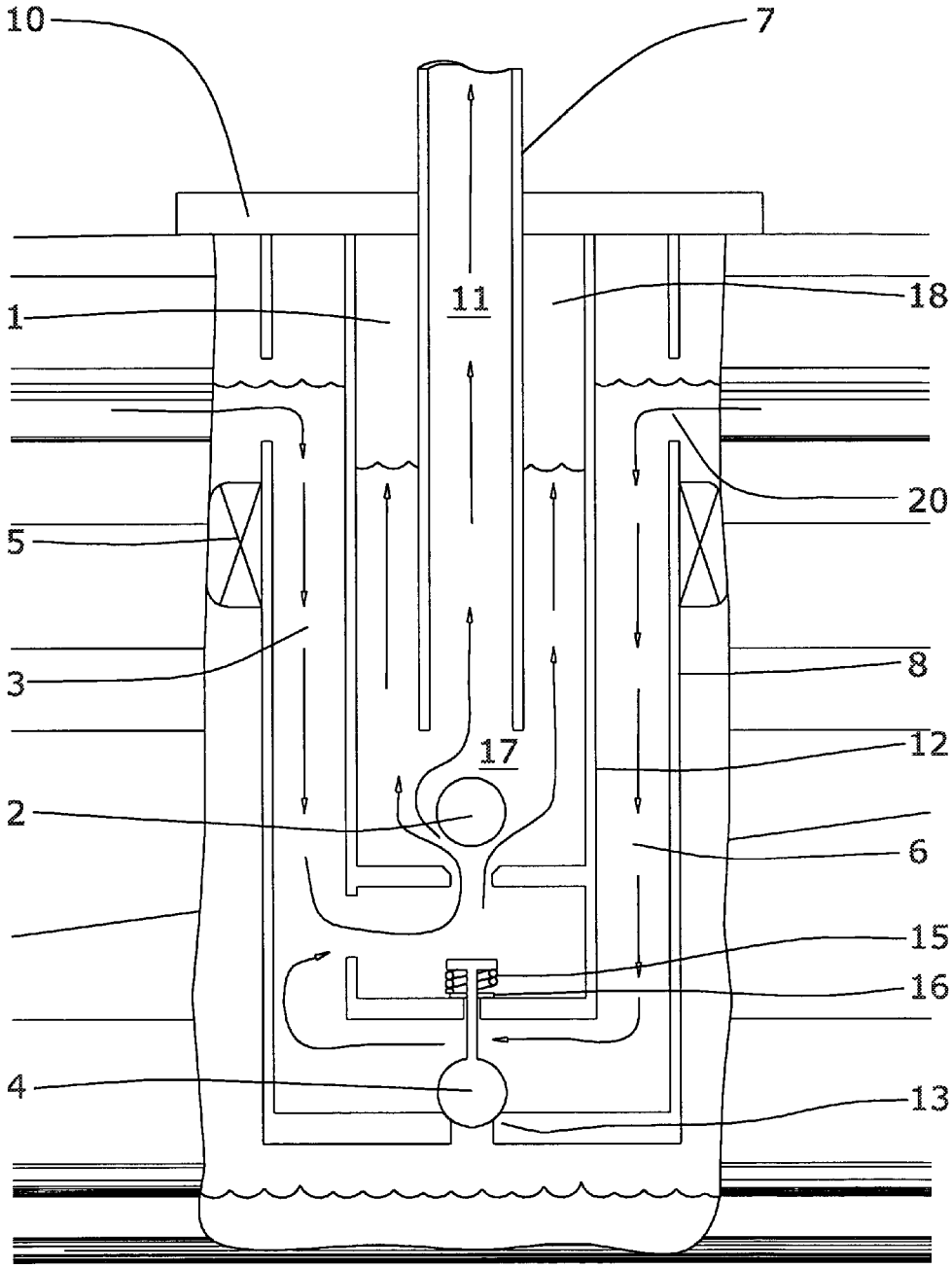
Figure 2A:
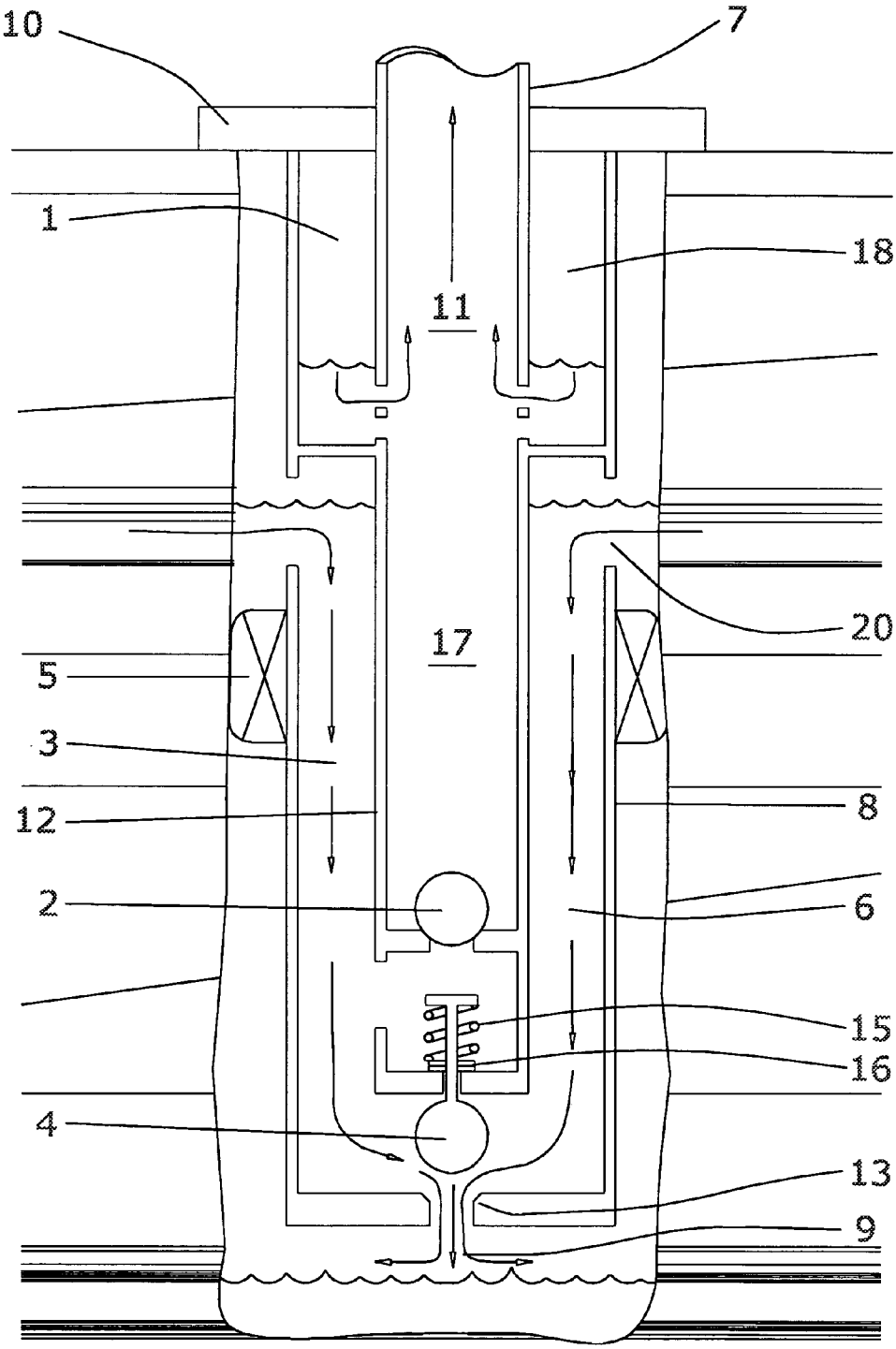
Figure 2B:
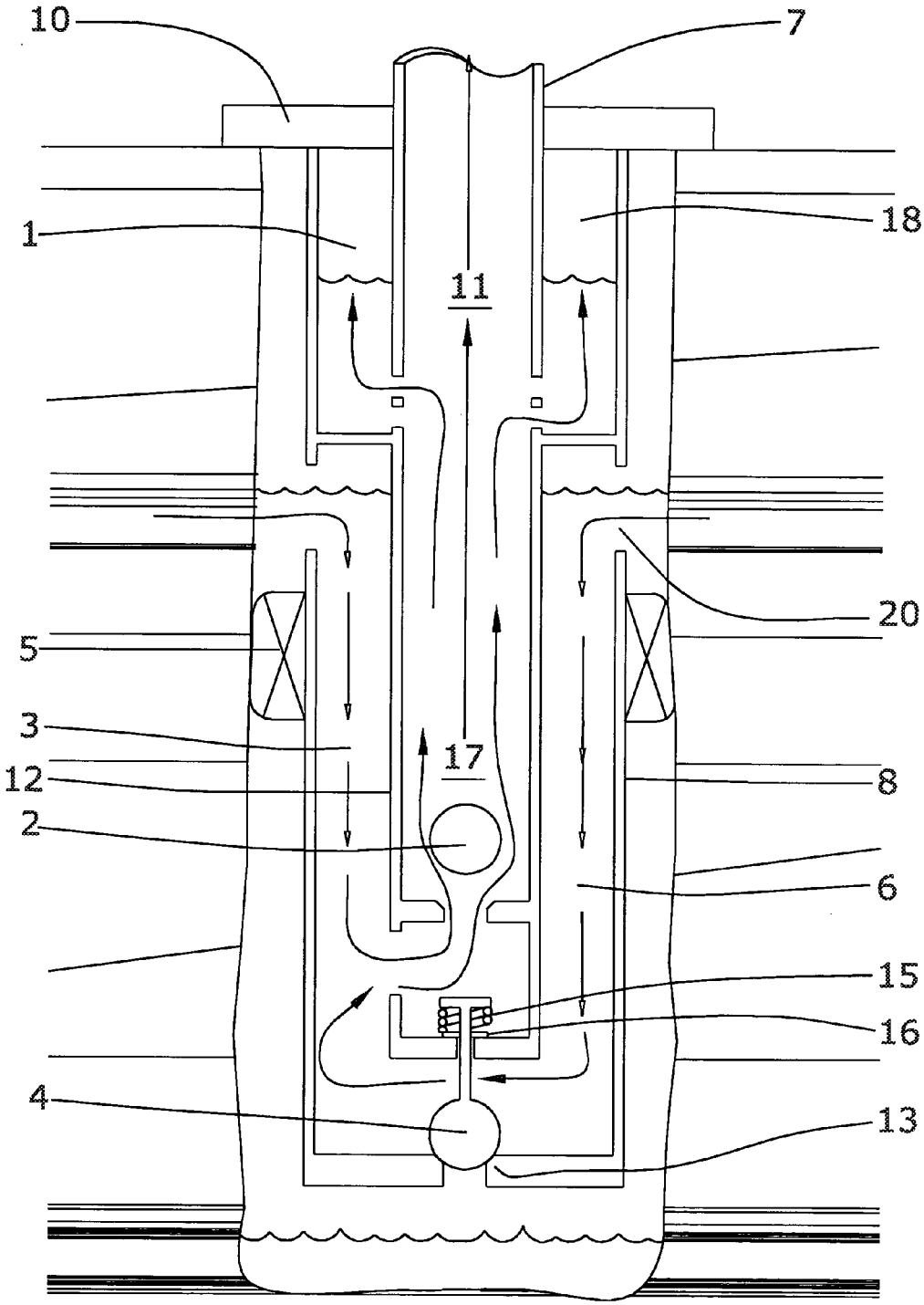
Figure 3:
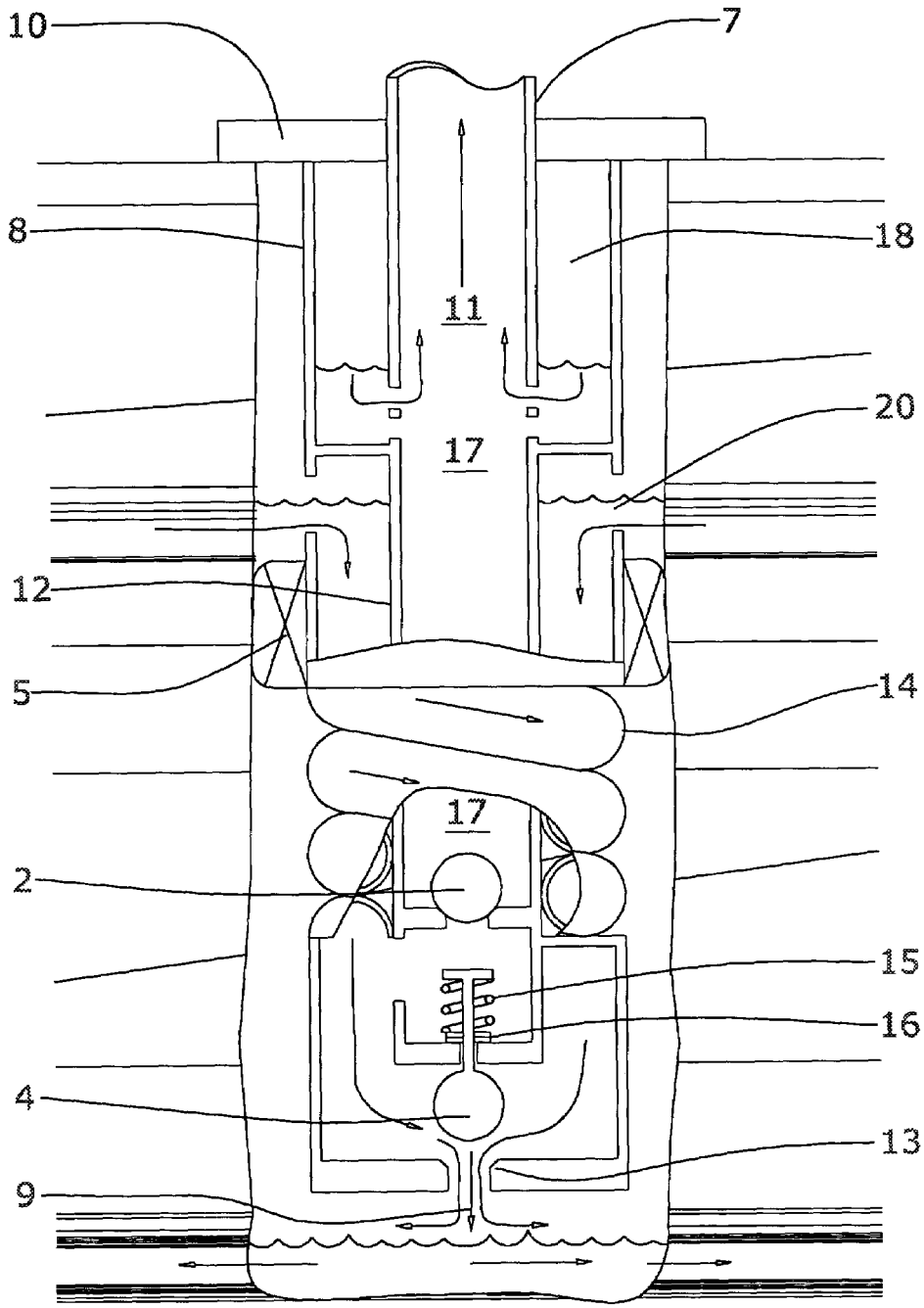
Figure 4:
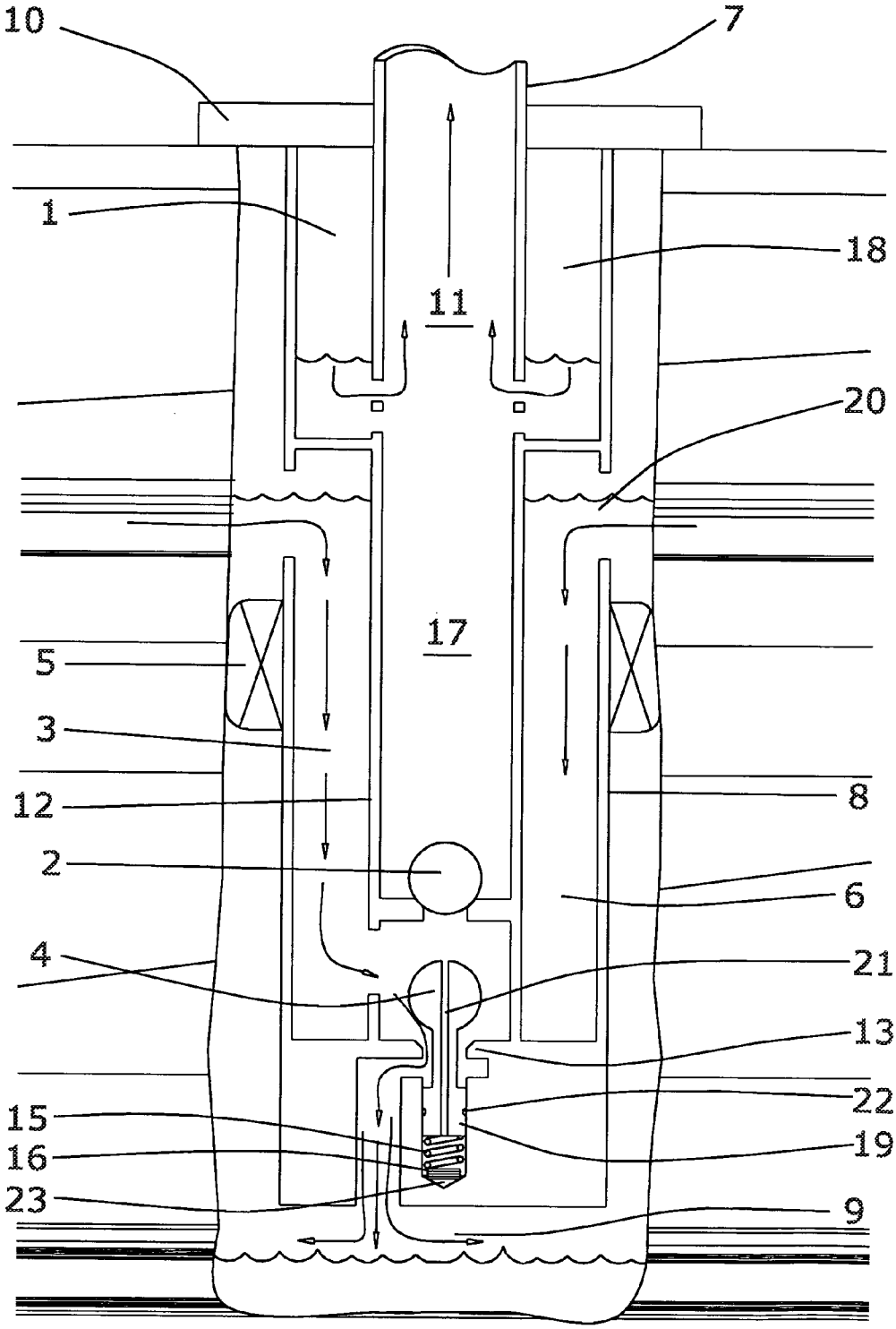
Figure 5:
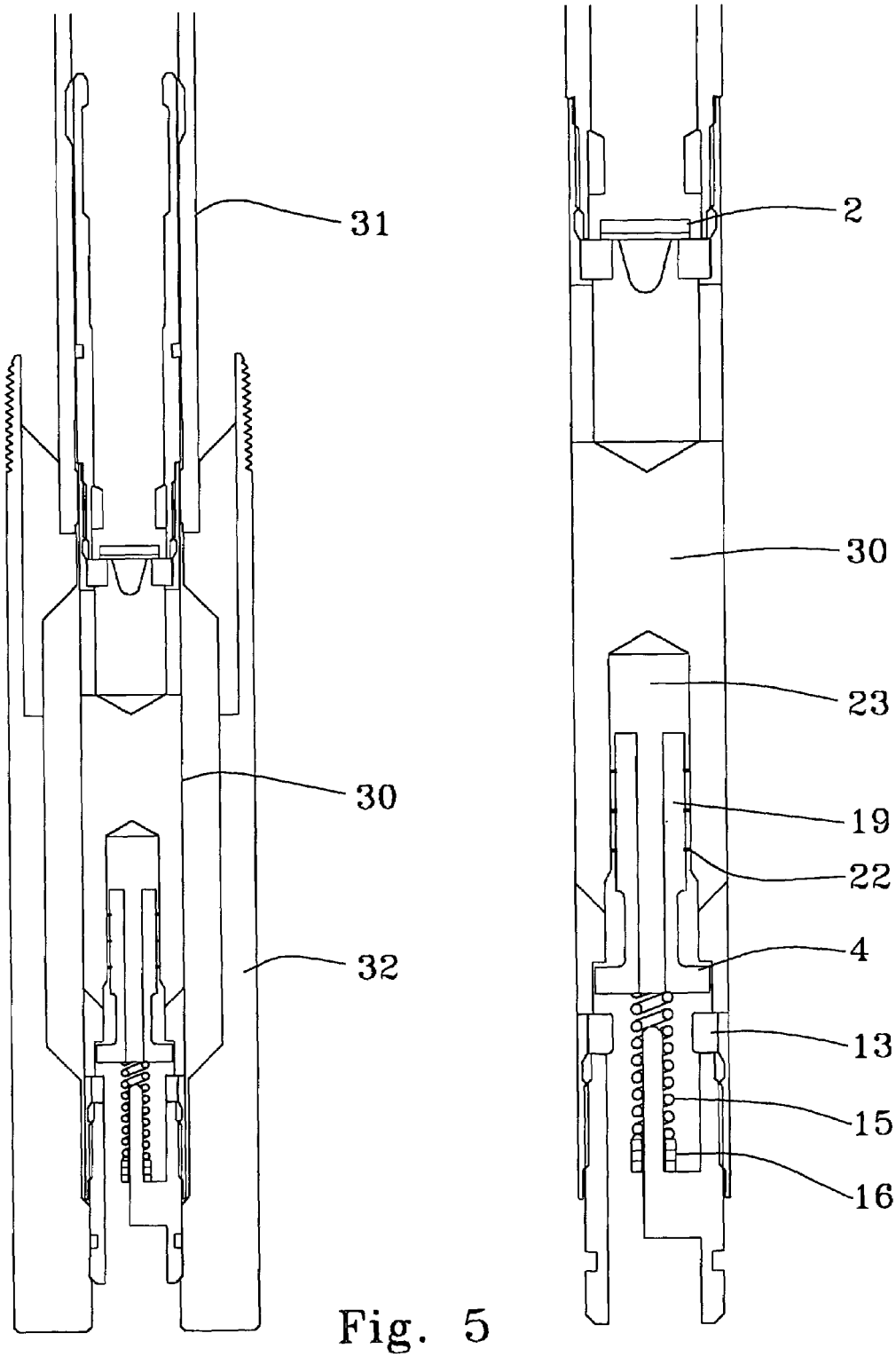
Figure 6:
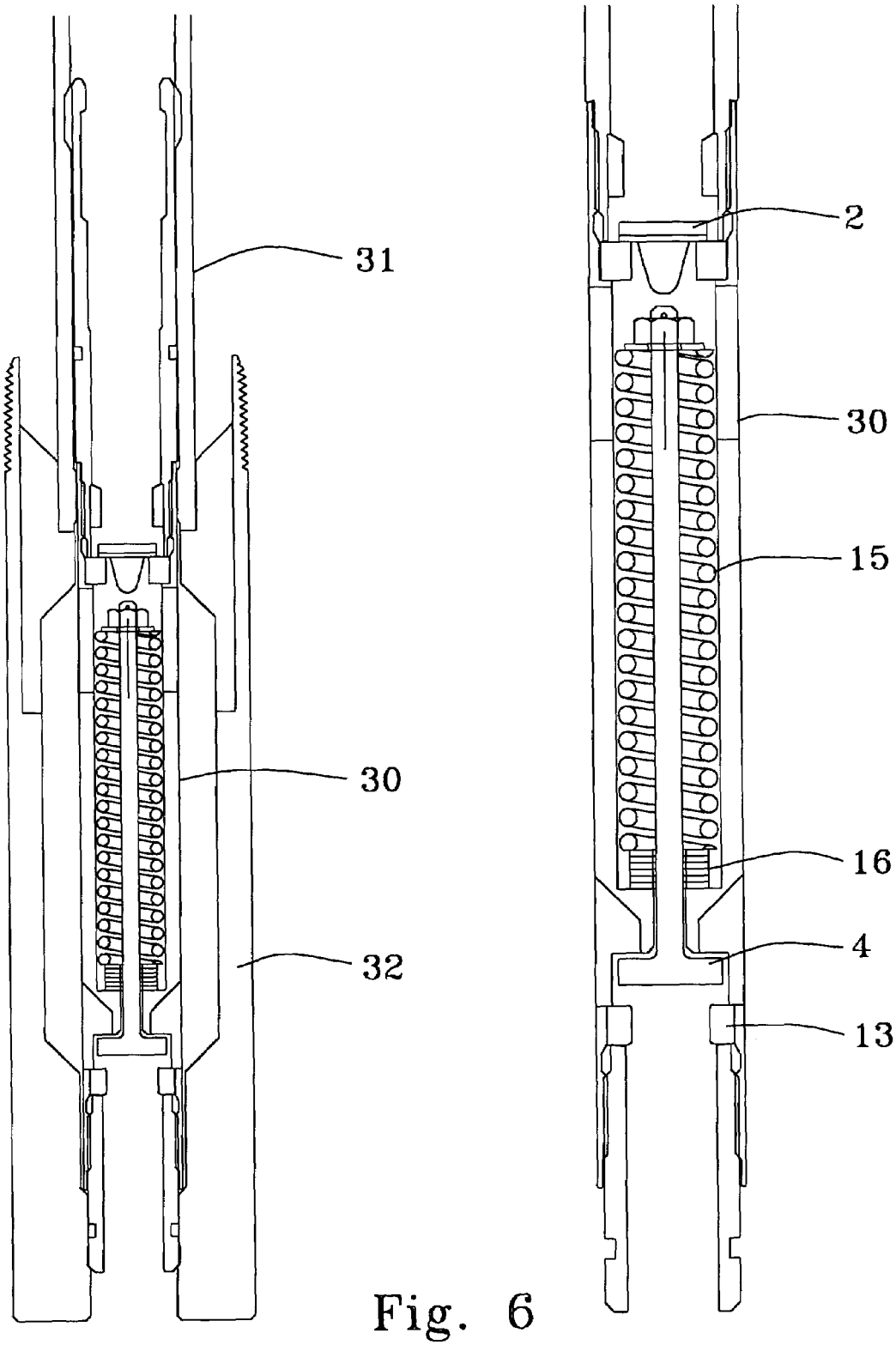

FIG. 1*a* installation depicting a downhole hydraulic ram pumping system shown with the impulse valve 4 in the open position and the check valve 2 in the closed position FIG. 1*b* installation depicting a downhole hydraulic ram pumping system similar to FIG. 1*a* with the impulse valve 4 in the closed position and the check valve 2 in the open position FIG. 2*a* installation of a preferred downhole hydraulic ram pumping system FIG. 2*b* installation of a preferred downhole hydraulic ram pumping system FIG. 3 installation depicting a coiled drive pipe FIG. 4 installation depicting pressure compensated valving FIG. 5 downhole hydraulic ram pump using a pressure compensating impulse valve exposed to the pump's backpressure FIG. 6 downhole hydraulic ram pump with impulse valve using a compression spring opening assist

DETAILED DESCRIPTION OF THE INVENTION

An object of this invention is to install the casing 8 (The casing discussed here is actually a large size production tubing. The wellbore liner, commonly referred to as casing, that is normally cemented in place is not discussed in this description but is in the claims.) from the surface to the desired location for the valving means. The casing 8 is provided with porting 20 located at the upper supply water level to allow the water to flow into the outer annulus 6 and fall downward to the hydraulic ram valving means. Porting 20 means to control the flow are also included in this invention. Well-known oil and gas equipment such as orifices, ported nipples, sliding side doors, and ball and flapper valves can be used. Sealing system means comprised of isolation packers 5 or cement are used to prevent the bypass of water between the earth wellbore wall and the casing 8 directing the flow to the porting means 20. A manifold for gathering water such as gravel pack and horizontal boring can be used to supply water to the outer annulus 6. An option is to use a sliding side-door as a porting means 20 to open or close the communication between the water stratum and the outer annulus 6. The flow control equipment of choice is the sliding side door, SSD. The well known SSD can be shifted open or closed from the surface by hydraulic or pneumatic control line or by using wireline tool methods. More than one SSD can be used to introduce water at lower levels during dry seasons and remain closed during rainy seasons resulting in more head to operate the ram. If the completion is a permanent type, the casing 8 should be cemented in place and the cement will provide the sealing means between the casing 8 and the wellbore wall. Other packers 5 can be set to isolate other water stratum. Landing nipples are installed in the casing 8 string to provide locations where tools can be installed and to provide a landing location for other flow controls and the ram pump. Also, landing nipples can be included in the delivery tube member for the installation of a standing valve.

The wellhead 10 could serve as an anchoring means for the casing 8, housing 12, and vertical conduit means, hereafter referred to as a delivery tube 7 in position from the surface. It will also provide ventilation for the annulus between the open wellbore hole and the casing 8, provide a pressure integrity cap for the pressure chamber 1, and provide passage of the delivery tube 7 through the wellhead 10 for the water 11 destination.

An object of this invention is to be able to retrieve from the wellbore certain concentrically nested sections as shown in FIGS. 1*a* and 1*b* while leaving other completion items in place such as the casing 8, sliding side-doors 20, isolation packers 5, and landing nipples. For example, the delivery tubing 7 could be retrieved separate and apart from the pressure chamber unit 12. The pressure chamber unit 12 is comprised of an adjacent chamber, hereafter referred to as pressure chamber 1, a second valve means, hereafter referred to as check valve 2, and a normally open lower valve means 4, hereafter referred to as impulse valve arranged in axial alignment to enable their retrieval as a unit. The casing 8 is left in place. The installation is in the reverse order, beginning with the pressure chamber 12 unit being lowered into the casing 8 within the wellbore until it seats in a landing nipple and stops on a restrictive shoulder (No-Go) connected to the casing 8 remaining in place in the wellbore. Next, the delivery pipe 7 is installed inside the pressure chamber 1 until it stops on a restrictive shoulder just above the upper check valve 2. The delivery tube 7 can be retrieved approximately one foot off of the restrictive shoulder for more efficient operation.

The larger outer annulus 6, defined by the large outer member 8, hereafter referred to as casing, and the inner member 12, hereafter referred to as housing, is the supply or drive pipe 6 used to convey the falling water column 3. In this configuration as shown in FIGS. 1*a* and 1*b*, the inner annulus 1 is a large pressure chamber containing a large volume of air with water 17 collecting in its lower end. A large volume of air 18 increases the efficiency with which the water 3 enters the pressure chamber 1. Water 3 can be rammed into the pressure chamber 1 with a large volume of air 18 without appreciably raising the chamber pressure, therefore using less energy for the process. The fraction of a second the surge pressure has to ram water 3 into the pressure chamber 1 can be spent introducing water 3 into the chamber 1 instead of raising the chamber pressure significantly. The small cyclic pressure fluctuations also provide a more uniform and efficient water 11 delivery to the surface elevation. The intrusive center delivery pipe 7 positioned axially at the center of the pressure chamber 1 is used to convey water to the surface. In this embodiment, the outlet is the lower end of the delivery pipe 7 that is covered with the water 17 contained in the pressure chamber 1. When water 17 exits the pressure chamber 1 the chamber pressure pushes it into the delivery pipe 7 upward.

In this invention, the energy for the ramming effect is not derived from the traditional momentum of flowing water from a spring or river but rather from kinetic energy created by the momentum of falling water 3 from upper elevation(s) to lower receiving elevation(s) in a wellbore. Water is conveyed by using conduit means comprised of: wellbore, horizontal boring, mining shaft, channel, casing, pipe, annulus, water strata, or a natural occurring opening such as a cave or fissure.

Locating the ram pump's valve means 30 comprised of a check valve 2 and an impulse valve 4 downhole in a wellbore enables the capture of the kinetic energy accumulated in the conduit for conveying falling water 3 by the pressure chamber 1. An impulse valve, being in the open position allows a water slug to pass through the invention pump and drive the impulse valve 4 on seat. It should be noted that as a slug is used a slug is usually replaced by the continual flow from the supply strata or formation filling the supply conduit 6, hereafter referred to as the drive pipe. The replenishment is at a sustainable flow rate from the formation. The pressure surge effect caused by suddenly stopping a falling water column 3 formed by water restrained in the drive pipe 6 does the work in this invention. The work done by the invention's unique hydraulic ram pump is lift or pump water from a wellbore to a higher elevation. After the water loses its kinetic energy and is discharged 9 from the ram pump, it is available for other purposes although on a lower horizontal elevation. The invention's pumping process is environmentally friendly, producing no harmful byproducts, and the water 9 used to lift or pump water is available again downstream of the process.

FIGS. 1*a* and 1*b*, this invention's impulse valve 4, closing at the downstream end of the falling water column 3, is slammed closed. The falling water 3 movement creates momentum of the water column 3 restrained in the drive pipe 6. The pressure from the water's momentum and friction flowing past the normally open impulse valve 4 causes a force acting to close the impulse valve 4. As the flow increases, it reaches a speed where a drag force is sufficient to start closing the impulse valve 4. Once it has begun to move, the impulse valve 4 closes very quickly, suddenly stopping the falling water column 3 restrained in the drive pipe 6 from flowing as a slug through the pump. As the momentum of the water column 3 rapidly diminishes by the closure of the impulse valve 4, a pressure surge is created for a short period of time that can be three to four times larger than the hydrostatic pressure of the water column 3 when the column is at rest and not moving. The magnitude of the pressure rise at the impulse valve 4 is proportional to the change in the water column's 3 developed velocity in the drive pipe 6 and the speed the compression shock wave propagates along the pipe 8. The water is rammed by means of the resulting pressure surge through a check valve 2, which admits water into a pressure chamber 1 and is captured by the closure of the check valve 2 after the surge pressure enters. Kinetic energy is thereby converted to pressure in an efficient manner sufficient to compress the air 18 in the upper end of the pressure chamber 1 and produce a lifting effect on a delivery water column 11 by the compressed air 18 pushing down on the water 17 exiting the pressure chamber 1. The normally closed check valve 2 separates this pressure chamber 1 from the water 3 to be rammed into the pressure chamber 1. The same pressure surge captured in the pressure chamber 1 has sufficient kinetic energy to lift a portion of the water 17 contained in the pressure chamber 1, exiting through an outlet means to a higher elevation in a delivery pipe 7 extending upward. As the pressure surge dissipates outside the pressure chamber 1, the normally closed check valve 2 closes and prevents the escape of water 17 and pressure from the pressure chamber 1.

After the closure of the lower impulse valve 4, the entire column of water 3 will not be brought to rest at once, due to the elasticity of the casing 8, housing 12, and water 3. A sudden reduction in the water 3 velocity causes a direct compression shock wave to form adjacent to the impulse valve 4. The magnitude of the pressure rise at the impulse valve 4 is proportional to the change in the water's 3 velocity and the speed the compression shock wave propagates up the casing 8. Higher pressures can be developed using materials that produce higher speeds such as steel pipe. For purposes of understanding the pressure transients, the column of water 3 is modeled using layers. The layer of water immediately adjacent to the valve 4 is first compressed, the casing 8 is expanded, and the housing 12 is compressed. This process follows with each elementary layer in succession from the impulse valve 4 to the supply intake ports 20 in the casing 8, thus having the nature of a compression shock wave propagating up the steel casing 8 at a velocity of 3,000 to 4,700 feet per second. Because of the stretching of the casing 8 and the increase in the volume of water 3, the casing 8 contains an additional volume of water in excess of that which existed for the at rest condition.

For a fraction of a second, the length of time for the compression shock wave to travel from the impulse valve 4 up to the supply intake port 20 elevation and the expansion shock wave to travel back to the impulse valve 4, the pressure surge is great enough to overcome the resistance of the upper check valve 2. This type of pressure rise is commonly known as "water hammer". As the pressure rises higher than that in the pressure chamber 1, water 3 is forced through the check valve 2 and into the chamber 1. The impulse pressure created by the kinetic energy of the falling water column 3 is greater than the column's static pressure, and it is this difference that is used to lift a portion of the water 17 in the pressure chamber 14 up the delivery pipe 7 to the surface elevation.

Furthermore, at the time of arrival of the compression shock wave at the supply intake ports 20 in the casing 8, the pressure inside the casing 8 near the ports 20 is greater than the hydraulic pressure of the water in the supply formation strata. Because of this unstable condition, a small amount of water 3 is forced back into the supply formation from the outer annulus or drive pipe 6. As a result of this velocity change, a reflected expansion wave is produced near the ports 20, which propagates from the supply intake ports 20 in the casing 8 down to the closed impulse valve 4. The layer of water in the pipe 6 adjacent to the supply intake ports 20 expands at once; the casing 8 surrounding it contracts; and the housing 12 expands, thus giving this layer of water an instantaneous velocity upward toward the supply formation and the water's free surface. The next layer follows and so on, creating five conditions behind the reflected wave: the casing 8 contracts from its expanded position, the housing 12 expands, the density of the water 3 is decreased, the pressure of the column of water 3 within the outer annulus 6 is reduced, and the column of water 3 has an instantaneous velocity upward.

When the reflected expansion shock wave reaches the closed impulse valve 4, a complete wave reflection occurs, and a second shock wave is established of opposite sign (expansion) to the original direct wave. As this wave travels upward toward the supply intake ports 20 in the casing 8, further contraction of the casing 8 and reduction in the density of the water 3 takes place behind the completely reflected shock wave. The mass of the water 3 moving upward creates a force that opens the impulse valve 4. This expansion shock wave will resemble water recoiling from the closed impulse valve 4, rather like a ball bouncing back, tending to vacate the area near the impulse valve 4 and thus expanding the water 3 causing a low-pressure condition. The opening of the impulse valve 4 produces an instantaneous velocity change that causes a direct expansion pressure wave to originate near the impulse valve 4. This direct expansion wave moves up the casing 8 in the same direction and at the same speed following the totally reflected wave. These two waves are very close and can be treated as one. The velocity of the water 3 inside the casing between the supply intake ports 20 and the wave front now has the same magnitude and direction as that which existed behind the reflected wave during its travel to the closed impulse valve 4. When the reflected expansion wave reaches the supply intake ports 20 in the casing 8, a second wave is propagated from this point to the valve 4. The effect of this wave is to again expand the pipe 8 and increase the density of the water 3. This wave initiates the closure of the impulse valve 4 by increasing the pressure and flow; therefore the entire cycle is repeated.

The condition created by the returning expansion shock wave, resulting in low pressure, will reopen the impulse valve 4 allowing the water column 3 to fall and again accumulate kinetic energy in the drive pipe 6. The spring bias force will complete the full opening of the impulse valve if this action is required. The bias force can be supplied by a conventional coiled compression spring 15, a dome charged piston, a combination of water and air in a chamber, or any other means devised to deliver this force.

The impulse valve 4 also provides a means to limit the movement of the valve 4 by changing the spring bias opening force. Varying different spring 15 and spacer 16 combinations can determine the desired opening force. During efficient operation the effect of the spring 15 could become negligible. Under these conditions of operation where the impulse valve 4 would be opened by developed transient pressure differentials, the spring 4 could be removed.

The upper check valve 2 is opened when the downward movement of the water column 3 continues even after the closure of the lower impulse valve 4. For a fraction of a second, the length of time for the compression shock wave to travel up to the supply formation elevation and the expansion shock wave to travel back, the instantaneous velocity of the water 3 is downward and will overcome the resistance of the check valve 2 allowing the water and a small amount of air to enter the pressure chamber 1 and delivery pipe 7 compressing the air 18 and lifting the delivery pipe water column 11 towards the earth's surface. The check valve 2 stays open until the water 3 passing the valve 2 has completely slowed down and the pressure of the water 3 to be rammed is near or drops below that of the pressure chamber 1. As the expansion shock wave passes the check valve 2 on its way to the impulse valve 4, the lower pressure will begin the closure of the check valve 2. Once the effect of the impulse pressure is dissipated, the check valve 2 will reseat under its weight or by spring force (not shown), therefore stopping any further backflow from the pressure chamber 1. In normal operating conditions, the check valve 2 can reseat under its own weight, or added weight, or it can be spring assisted to cause quick closure and less water bypass during closure. The design and configuration of the check valve 2 is the greatest factor in determining the combined efficiencies of the ram. Were the check valve 2 area to be increased, the conversion of velocity to pressure energy would be made more efficient. Therefore, it is an object of this invention to maximize the size of the check valve(s) 2 and provide a spring (not shown) or additional weight to assist closure.

The drive pipe 6 of this invention can be found in a number of configurations: an axially parallel pipe with the delivery and pressure chamber pipes where all three pipes are installed parallel to each other in the wellbore; FIGS. 1*a* and 1*b* where the three pipes are concentric; where some of the pipes are concentric; a configuration shown in FIG. 3 where the drive pipe 14 is coiled downwardly, similar to a coiled spring, around or near the delivery pipe 7 or pressure chamber 1 or pressure chamber 1 and delivery pipe 7. An object of this invention is to provide a drive pipe 6 configuration that will increase the efficiency of the pumping system. Increasing the mass of water in motion and reducing the size of the slug of water passing through the pump increases the efficiency. The efficiency of the pump can be improved by adding the angular momentum component to that of linear momentum. Increasing the length of time the shock wave takes to make one cycle can increase the efficiency. Increasing the length of the drive pipe 6 within a given effective distance can accomplish the task. Drive pipes 6 were normally installed with a long horizontal component and not the shortest vertical distance. This construction would increase the mass involved as well as lengthen the time the shock wave takes to make one cycle. In a similar manner, this invention uses a coiled drive pipe 14 to increase the time the shock wave takes to make one cycle. The change in volume of a curved pipe seems to be greater than that of a linear section of same volume when subjected to the same impulse pressure differential. This is especially important when considering the change in angular momentum. The dynamic movement of the coiled drive pipe 14 seems to be more than that of a linear section of same volume subjected to the same conditions. Therefore, the use of a coiled drive pipe 14 can increase the efficiency of the ram.

As shown in the top view, the ram pump is shown where the flow of supply water entering the lower annulus by way of slotted porting means located in the casing is directed downward in the lower annulus and continues downward to an impulse valve. The falling water passes the normally open impulse valve and exits the pump as discharge water. Upon closure of the impulse valve during the pumping action, a portion of the falling water is periodically redirected upward into the pressure chamber through a normally closed check valve intermittently operated by the flow of falling water. Upon entering the pressure chamber extension, the falling water compresses the air located in the upper part of the annulus and also lifts the water causing the water to flow to the surface elevation. As the flow of drive water slows to a halt, the check valve closes and the compressed air located in the upper annulus causes the water in the upper annulus to retract forcing the water up the delivery pipe.

As shown in FIGS. 2*a* and *b*, the hydraulic ram or impulse pump is a device that employs the energy of the falling drive water 3 to lift a lesser amount of delivery water 11 higher than the source elevation. There are only two moving parts, thus minimizing the maintenance. For these reasons the hydraulic ram pump is an attractive solution where a large gravity flow can be created or is found to exist. A hydraulic ram pump should be considered when there is a water source, free of sand, which can provide at least seven (7) times more water than the ram pump is to deliver to the surface. The water source must be located above receiving strata capable of receiving the wastewater or can be improved to do so. The following are the design factors for the successful operation of the pump:

The difference in height between the water source and the pump site (vertical fall H)

The difference in height between the pump site and the surface (lift L)

The quantity of flow available from the source (supply water level)

The length of pipe from the source to the pump (drive pipe annulus 6)

The length of pipe from the pump to the surface (delivery pipe 7)

As shown in FIGS. 2*a* and *b*, the present invention relates to hydraulic ram pumps and more particularly to a ram pump installed in a wellbore wherein the flow of supply water entering the lower annulus 6 referred to as the drive pipe, by way of a slotted porting 20 means located in the casing 8 is directed downward in the lower annulus 6 and continues downward to an impulse valve 4. The falling water 3 passes the normally open impulse valve 4*a* and exits the pump as discharge water 9. Upon closure of the impulse valve 4*b* during the pumping action, a portion of the falling water 3 is periodically redirected upward into the pressure chamber 1 through a normally closed check valve 2*b* intermittently operated by the flow of the falling water 3. Upon entering the pressure chamber 1 the falling water 3 compresses the air 18 located in the upper part of the upper annulus 18 and also lifts the delivery water column 11 causing the delivery water to flow to a higher elevation. As the flow of drive water 3 slows to a halt, the check valve 2*b* closes and the compressed air 18 located in the upper annulus 1 causes the water 17 in the pressure chamber 1 to retract forcing delivery water 11 up the delivery tube 7 to a higher elevation.

The closure of the impulse valve 4 can be violent at greater wellbore depths and greater pressures. An object of the invention is to increase its durability by providing a means to counteract the large closure forces acting on the impulse valve 4 and yet provide a large opening for slugs of water to flow through the ram pump. The preferred approach as shown in FIG. 2*a, b*, and 6 is to use a coiled compression spring 15 to provide the counteracting force. At greater pressures the spring force becomes excessive to the point where insufficient drag force can be developed to close the impulse valve 4. FIG. 4, and 5, for greater pressures in deep wellbore applications, a counter-acting piston 19 approximately the same size as the impulse valve 4 and exposed to the same differential pressure is used. The preferred configuration is an opposing piston 19 cylinder 23 configuration using the same pressure differential on both the impulse valve 4 and the opposing piston 19 to provide the opposing force. The piston 19 and the impulse valve 4 are integral or joined by a connection to form a subassembly. The small weight of the valve 4 and its movement will produce a maximum area for a large flow rate of water, and pressure thereon will be nearly balanced, thus greatly reducing the force of closure. The force resulting from pressure acting on the impulse valve 4 closure area is counter acted by the same pressure acting on an opposing piston 19 in the opposite direction. Communication of the pressure to both is through a hole 21 from the center of the impulse valve 4 to the center of the piston 19. The size of the communication port 21 between the impulse valve 4 and the piston chamber 23 should be large enough to not restrict the flow and still allow the impulse valve 4 to close quickly, thus conserving the energy accumulated in the drive pipe 6, resulting in greater efficiency of the ram. In contrast, a smaller hole 21 could result in a slower movement of the impulse valve 4 due to the resistance to the flow of the fluid that would dampen the effect of the closure, resulting in less efficient ram operation.

An object of this invention is to be able to change the impulse valve's 4 closure area by using different sizes of replaceable seats 13. The replaceable seats 13 are reversible, having a combination of large and small valve closure areas or the same on both sides. Increasing the valve's 4 closure area will allow the water flow area to be increased thereby enabling more water 3 to pass through the seat 13 for a given time period. Increasing or decreasing the impulse valve 4 closure area (bounded by the continuous seal line) increases or decreases the closing force respectively. An installation where the water column 3 in the drive pipe 6 is hundreds of feet high creates an excessive closure force when the impulse valve 4 is driven on seat 13. To reduce the closure and opening force, the impulse valve 4 closure area and the opposing piston 19 area approximate the same size with the piston 19 area being slightly less. Also, an object of this invention is to be able to change the replaceable seats 13 as needed for maintenance.

Applications involving large hydrological heads could require hard materials be used to manufacture the impulse seat 13 and impulse valve 4. It should be noted that a soft seat 13 could be used successfully when the closure forces are relatively small.

An object of this invention is to increase the efficiency by using a unique impulse valve 4 means for regulating the sensitivity to pressures and forces as well as the frequency of impulses and the length of time between impulses. The impulse valve 4 of choice enables the ram to work faster in pumping water and to perform its functions with less loss to water slugs passing through the invention pump. The design allows the impulse valve 4 to open quickly after the necessary impact, thus giving the valve action greater speed, and to provide a more rapid stroke or pulsation of the impulse valve 4. An accelerated movement of the impulse valve 4 gives the greatest efficiency because it conserves more of the accumulated energy developed in the drive pipe 6.

All work done is completed during the fraction of a second before the water column recoil is seen at the impulse valve 4. The short optimum distance between valves will enable the high and low impulse pressures acting near the impulse valve 4 to also act on the check valve 2 as well, allowing quick closure of the check valve 2 as the impulse valve 4 opens. If the distance is increased then the check valve 2 cannot benefit as much from the high and low impulse pressures acting near the impulse valve 4, and the check valve 2 closure will be slower.

A water wellbore completion where the water column 3 that is restrained in the outer annulus 6 is hundreds of feet high creates an excessive closure force when the impulse valve 4 is driven on seat 13. The same column 3 creates a pressure that acts on the closed impulse valve 4 that requires a large reopening force from a compression spring 15. It is conceivable the spring force could be so great that the impulse valve 4 could not be closed by the water flow through the pump. In this case a pressure compensated impulse valve as shown in FIG. 4 is used to reduce the opening and closure forces involved.

The invention's pump increases its durability by providing a design to counteract these large forces acting on the impulse valve 4. The preferred configuration is the use of a counteracting piston 19 exposed to the same pressure as the impulse valve 4. The piston 19 and the impulse valve 4 are integral or have a threaded joint between them. The small weight of the valve and its movement can produce a maximum area for a large flow rate of water. The pressure compensated impulse valve closure area and the opposing piston area are approximately the same size with the piston 19 area being slightly less. The pressure acting on both the impulse valve 4 and the piston 19 will create opposing forces that are nearly balanced, thus greatly reducing the force of closure and reopening. The resultant force will from the pressure keep the impulse valve 4 in the closed position. This force can be easily overcome by a spring 15.

The water-column 3 static pressure or as shown in FIG. 5 the receiving stratum pressure (pump backpressure) can be used. In FIG. 4 the water column pressure is used. The force resulting from pressure acting on the impulse valve 4 closure area is counter acted by the same pressure acting on an opposing piston 19 in the opposite direction. By changing the size of the counteracting piston 19 the pressure sensitivity can be changed as well as the closure and opening forces. Communication of the pressure to the opposing piston is through a hole at the center of the impulse valve 4 and the piston 19 as seen in FIG. 4. An alternate method for communication is to use tubing across the valve or provide a drill hole to pass the pressure around the valve 4 to the opposing piston 19.

Increasing the valve's 4 closure area will allow the water flow area to be increased thereby enabling more water to pass through the seat 13 for a given time period. The size seat 13 is chosen to set a sustained maximum water flow rate from the supply aquifer. Smaller seats 13 can be used as needed. Increasing or decreasing the impulse valve 4 closure area (bounded by the continuous seal line) increases or decreases the closing and opening force respectively. The replaceable seats 13 are reversible, having a combination of large and small valve 4 closure areas or the same on both sides.

The impulse valve 4 of choice enables the ram to work faster pumping water 11 and to perform its functions with less loss of the supply aquifer water 3 through the pump. The design allows the impulse valve 4 to open quickly after the necessary impact, thus giving the valve 4 action greater speed, and to provide a more rapid stroke or pulsation of the impulse valve 4. An accelerated movement of the impulse valve 4 gives the greatest efficiency because it conserves more of the accumulated energy developed in the outer annulus 6 known as the drive pipe or energy accumulator. The velocity of the water column 3 is not reduced significantly provided the closure of the impulse valve 4 is rapid. The efficiency of the hydraulic ram pump can be increased by using a unique impulse valve 4 design for regulating the sensitivity to pressures and forces as well as the frequency of impulses and the length of time between impulses.

The chosen compression spring 15 force when the impulse valve is closed should create a force near the magnitude of the force caused by the static water column 3 pressure on the resultant area of the valve 4. Use a small force when possible to reopen the impulse valve 4 that can be overcome by the forces developed by the flow of water 3 through the valve. The spring 15 of choice should have a small rate of change in force with the change in length.

FIG. 4 is a side view of an installation depicting a hydraulic ram pumping system embodying the invention herein. The object of the present invention is to provide a new hydraulic ram pump of the type constructed to be used in a wellbore wherein the pressure chamber 1, check valve 2, impulse valve 4, and counteracting piston chamber 5 are arranged respectively in axial alignment to be useful in a wellbore.

The larger outer annulus 6, defined by the casing 8, and the housing 12, is the drive pipe used to convey the falling water column 3 from an upper strata water supply level to the valving means comprised of the upper check valve 2 and the lower impulse valve 4. In the preferred configuration, the inner annulus 18 is a large pressure chamber 1 defined by the housing 12 (a continuation of the casing 8), the delivery tube 7 (a continuation of the housing 12), and wellhead cap means 10 contains a large volume of air with water 17 covering its lower end. The intrusive center delivery tube 7 positioned vertically at the center of the pressure chamber 1 causing an inner annulus 18 to be formed, is used to convey delivery water 11 to a higher elevation.

The hydraulic ram pump is comprised of two moving parts: the upper check valve 2 and the lower impulse valve 4. The lower impulse valve 4 being in its normal open position admits the column of water 3 into the pump, and when sufficient drag force is developed, drives the impulse valve 4 on seat 13. The drag force acting to close the impulse valve 4 causes a quick closure, suddenly stopping the falling water column 3 contained in the outer annulus 6 from flowing through the pump and exiting as discharge water 9. The recoil of the water column 3 at once allows the impulse valve 4 to reopen until the returning flow of the next cycle drives the impulse valve 4 on seat 13. The action is repeated indefinitely.

After the closure of the lower impulse valve 4, the entire column of water 3 will not be brought to rest at once, due to the elasticity of the casing 8, housing 12, and water 3. For a fraction of a second, the length of time for the compression shock wave to travel up to the slotted porting means 20 and the expansion shock wave to travel back to the impulse valve 4, the pressure surge is large enough to overcome the resistance of the upper check valve 2. As the pressure rises higher than that in the pressure chamber 1, it forces water 3 through the check valve 2.

The instant the expansion shock wave returns, the pressure in the column of water 3 within the outer annulus 6 is reduced, and the column of water 3 has an instantaneous velocity upward or a recoil effect. Restating the condition, the water column's 3 pressure has been reduced to its original pressure, and the entire column has a net velocity upward. The mass of the water moving upward creates a force that reopens the impulse valve 4 allowing the water column 3 to flow through the seat 13 and again accumulates kinetic energy in the outer annulus 6.

The impulse valve 4 can limit its play by changing the spring 15 bias opening force. Different spring 15 and spacer 16 combinations will yield the desired force for opening. The spring 15 bias force will complete the full opening of the valve 4-*a* if this action is required.

The opening impulse valve 4 causes the water 3 to flow down through the seat 13 becoming discharge water 9 that creates a smaller loss of pressure. The entire column of water 3 will not flow at once; therefore, the low-pressure condition propagates up the outer annulus 6 reversing the velocity component downward thus starting a new cycle.

The upper check valve 2 is opened when the downward movement of the water column 3 continues even after the closure of the lower impulse valve 4. For a fraction of a second, the length of time for the compression shock wave to travel from the closed impulse valve 4 up to a slotted porting means 20 and the expansion shock wave to return, the velocity of the water 3 is downward and will overcome the resistance of the check valve 2 allowing the water to be rammed into the pressure chamber 1 and delivery tube 7 compressing the air 18 and lifting the delivery tube water column 11 towards the surface. The check valve 2 stays open until the water 3 passing the valve 2 has almost completely slowed down and the pressure near the impulse valve 4 drops below the pressure chamber 1. As the expansion shock wave passes the check valve 2, the lower pressure will begin the closure of the check valve 2. Once the check valve 2 starts to close it will reseat with a small amount of backflow, therefore stopping any further water 17 loss from the pressure chamber 1. It is an object of this invention to maximize the size of the check valve 2 to improve performance. In static conditions, the check valve 2 can reseat under its own weight, or it can be spring (not shown) assisted to cause quick closure therefore minimizing water 17 bypass during closure.

FIG. 4, an object of the invention is to increase the downhole ram's durability by providing a means to counteract the large closure forces acting on the impulse valve 4. The preferred configuration is the use of a piston 19 exposed to the same pressure as the impulse valve 4. The piston 19 and the impulse valve 4 are integral. The small weight of the valve 4 and its movement will produce a maximum area for a large flow rate of water, and pressure thereon will be nearly balanced thus greatly reducing the force of closure. The force resulting from pressure acting on the impulse valve closure area is counter acted by the same pressure acting on an opposing piston 19 in the opposite direction. Communication of the pressure to both is through a hole 21 from the center of the impulse valve 4 to the center of the piston 19.

An object of this invention is to be able to change the impulse valve's closure area by using different sizes of replaceable seats 13. The replaceable seats 13 are reversible. The replaceable seats 13 have a combination of large and small or the same size valve closure areas on both sides. The small valve closure area will give a smaller closing force while a large valve closure area will give a larger closure force. This is an advantage to have a choice of valve closure areas when there are installations where the water column 3 could be hundreds of feet high creates an excessive closure force when the impulse valve 4 is driven on seat 13. Therefore, to reduce the closure and opening force, the impulse valve closure area and the opposing piston area should be approximately the same size with the piston area being slightly less.

The counteracting piston 19 has a seal 22 between the piston 19 and the counteracting piston chamber housing 23 polished bore. The seal 22 does not have to be a pressure tight seal only a seal, to retard the flow of water. Many seal configurations can be used: close fit, v packing, o-ring, cup seal, labyrinth rings, and piston rings.

A producer of this invention should manufacture the seat 13 from hard materials in applications involving large hydrological heads. A soft seat can be used when the closure forces are relatively small.

An object of this invention is to be able to change the replaceable seats 13 as needed for maintenance. If the valve closure areas were the same on both sides of the seat 13 then the seat could be flipped over and used as a new seat with a new sealing surface.

An object of this invention is to increase the efficiency of the downhole hydraulic ram pump by using a unique impulse valve 4 design for regulating the sensitivity to pressures and forces as well as the frequency of impulses and the length of time between impulses. By changing the size of the counteracting piston 19 the pressure sensitivity can be changed as well as the closure and opening forces. The embodied impulse valve 4 enables the ram pump to work faster pumping water and performing its functions with less loss of the operating water 3 as discharge water 9. The design allows the impulse valve 4 to open quickly after the necessary impact, thus giving the valve 4 action greater speed.

All work done is completed during the fraction of a second before the water column 3 recoil is seen near the impulse valve 4. The short length between will enable the high and low impulse pressures acting near the impulse valve 4 to also act on the check valve 2 as well, allowing quick closure of the check valve 2 as the impulse valve 4 opens and quick opening of the check valve 2 as the impulse valve 4 closes. If the length is increased then the check valve 2 cannot benefit as much from the high and low impulse pressures acting near the impulse valve 4 and the check valve 2 closure will be slower.

An object of this invention is to be able to retrieve from the wellbore certain sections, such as a valve unit, while leaving other completion items in place such as the casing 8, sliding side doors 20, isolation packers 5, and landing nipples. The delivery tube 7 can be retrieved separate and apart from the pressure chamber. The installation is in the reverse order, beginning with the pressure chamber being lowered into the wellbore until it seats in a landing nipple and stops on a restrictive shoulder (No-Go) connected to the casing 8 left in place in the wellbore. Next, the delivery tube 7 is installed inside the pressure chamber 1 until it stops on a restrictive shoulder just above the upper check valve 2. The delivery tube 7 can be retrieved about one foot off of the restrictive shoulder for more efficient operation.

Thus the invention consists of a hydraulic ram pump embodying these novel features of construction and arrangement of parts, which will be hereinafter fully described and claimed.

What is claimed is:

1. A downhole hydraulic ram pump for lifting formation fluids out of a wellbore being an open hole, comprising:

a main body having an axial bore;

a formation fluid inlet connected to said axial bore at one end of said main body;

means forming a formation fluid outlet for conducting fluid flow from the other end of said main body;

a normally open valve means axially aligned with said main body located within the fluid passageway for permitting fluid flow conducted out of said formation fluid outlet end, and into a formation external of the pump;

a chamber means having a normally closed inlet means axially aligned with said main body;

means for receiving, landing, sealing, and securing said chamber means within said main body axial bore;

an annulus formed between said chamber means and said main body, means forming a flow passageway such that formation fluid can flow into said formation fluid inlet end of said main body, into said formed annulus, to said normally open valve means, whereas the formation fluid flow is permitted from said normally open valve means, into said formation fluid outlet, such that formation fluid flow passes from the said formation fluid outlet as discharge fluid;

said chamber means, wherein said normally closed inlet means is comprised of at least one normally closed valve means axially aligned with the said chamber means being located in the fluid inlet passageway for permitting fluid flow to said chamber means;

said chamber means, wherein said normally closed inlet is extended axially, aligned with said chamber means, having at least one side port for formation fluid flow to said normally closed valve means, forming a landing profile with restrictive shoulders and seal system to interact with said main body;

said chamber means having a normally closed inlet at one end, means forming a connection adapted for chamber tubing on said chamber means other end, said chamber tubing being added to said chamber means for desired chamber volume, having a tubing capping means affixed to the open chamber tubing end;

said chamber means, further including said chamber tubing and said affixed capping means, wherein an intrusive tubing means parallel or axially aligned with the said chamber means, through which at least one fluid outlet end adapted for tubing connection is provided, said intrusive tubing means penetrating and sealing against said affixed capping means;

said intrusive tubing means providing a fluid passageway such that formation fluid can flow from said chamber means near said normally closed inlet means end, through said affixed capping means, to said adapted outlet end;

said chamber means, wherein an annular chamber is formed between said chamber means and said intrusive tubing means, provides an annular collecting chamber for a gaseous substance;

a conduit means having at least one formation fluid inlet means, providing a fluid passageway for conducting said formation fluid downward is connected to said formation fluid inlet.

2. A downhole hydraulic ram pump according to claim 1, whereas said conduit means further includes at least one sealing means providing a seal between said open hole and said conduit means, having at least one landing profile means for receiving flow control devices and tubing hanging devices, is connected to said hydraulic ram pump at said formation fluid inlet.

3. A conduit means of claim 2, whereas said conduit means is comprised of tubing axially aligned with the said chamber means, creating an annular fluid passageway such that formation fluid flow in said annular fluid passageway is downward, into said formation fluid inlet and into said downhole hydraulic ram pump.

4. A conduit means of claim 2, whereas said conduit means is comprised of tubing aligned parallel with said chamber means, such that formation fluid flow in said tubing is downward into said formation fluid inlet and into said downhole hydraulic ram pump.

5. A conduit means of claim 2, whereas said conduit means is comprised of tubing coiled around said chamber means in a downward direction, such that formation fluid flow in said coiled tubing spirals downward reaching said formation fluid inlet and into said downhole hydraulic ram pump.

6. A conduit means of claim 1, whereas said conduit means having at least one formation fluid inlet means that is controllable.

7. A downhole hydraulic ram pump of claim 1, whereas at least one sealing means is providing a seal between said open hole and said downhole hydraulic ram pump.

8. A downhole hydraulic ram pump according to claim 1, whereas a distribution piping means: further connected to said intrusive tubing means adapted fluid outlet, providing a fluid flow path upward such that fluid can flow from said chamber means near said normally closed inlet means end, into said intrusive tubing means, through said affixed capping means, to said intrusive tubing means adapted outlet end, into said distribution piping means, to a higher elevation or to an earth surface elevation.

9. A downhole hydraulic ram pump according to claim 1, further including said conduit means, including at least one sealing means providing a seal between said open hole, said conduit means, and said chamber means, whereas said intrusive tubing means comprises a tubing means;

said affixed capping means comprises a wellhead means;

said chamber means and conduit means originate from said wellhead means, stretching downward in a wellbore being an open hole, to said downhole hydraulic ram pump;

said tubing means provides a flow passageway such that fluid can flow from said chamber means near said normally closed inlet means end, through said wellhead means, to said surface.

10. A downhole hydraulic ram pump according to claim 1, whereas said affixed capping means provides a communication port to said annular chamber.

11. A downhole hydraulic ram pump according to claim 8, whereas said distribution piping means extending from said affixed capping means provides fluid valves, flow controls, and storage.

12. A downhole hydraulic ram pump according to claim 1, whereas said normally open valve means employs an adjustable spring to maintain said normally open valve means in the normally open position, said normally open valve remains open until the adjustable spring force is overcome by said discharge fluid flow force.

13. A downhole hydraulic ram pump according to claim 1, whereas said normally open valve means employs an opposing slidable piston and cylinder means responsive to formation fluid pressure acting on both said normally open valve means and said opposing piston and cylinder means to approximately balance the valve closure forces;

said valve closure forces are slightly biased to close said normally open valve means;

said normally open valve means and said opposing piston means are integral having an axially aligned communication port;

said normally open valve means employs an adjustable spring to maintain said normally open valve means in the normally open position.

14. A downhole hydraulic ram pump according to claim 1, whereas said normally open valve means employs an opposing slidable piston and cylinder means responsive to pump back pressure acting on both said normally open valve means and said opposing piston and cylinder means to approximately balance the valve closure forces;

said valve closure forces are slightly biased to close normally open valve means;

said normally open valve means and said opposing piston means are integral having an axially aligned communication port;

said normally open valve means employs an adjustable spring to maintain said normally open valve means in the normally open position.

15. A downhole hydraulic ram pump according to claim 1, whereas said normally closed valve means employs an adjustable spring or weight, said adjustable spring or weight maintains said normally closed valve means in the normally closed position until the adjustable spring force or weight is overcome by formation fluid flow force as said formation fluid flow enters said pressure chamber means.

16. A downhole hydraulic ram pump according to claim 1, whereas in lieu of said normally closed valve means and said normally open valve means includes a wireline retrievable valve unit, axially aligned with the said chamber means, comprised of a normally closed valve means, a normally open valve means, and a wireline tool profile for running and pulling said wireline retrievable valve unit;

said wireline retrievable valve unit outer profile can be landed, sealed, and secured within an internal profile disposed within said chamber means extended inlet and said main body formation fluid outlet;

having at least one side port for formation fluid flow to said wireline retrievable valve unit normally closed valve means;

having at least one side port for formation fluid flow to said wireline retrievable valve unit normally open valve means; said side port aligned with a fluid passageway exterior of said chamber means extension and into said main body;

retrievable through said chamber means extension continuing upwards trough said intrusive tubing means.

17. A downhole hydraulic ram pump according to claim 1, said normally closed valve means further comprises a replaceable check valve and seat, said seat being reversible.

18. A downhole hydraulic ram pump according to claim 1, said normally open valve means further comprises a replaceable impulse valve and seat, said seat being reversible.

19. A downhole hydraulic rain pump according to claim 1, whereas said main body is not connected to said conduit means, but said main body is retrievable, axially aligned with said chamber means and can be landed, locked, and sealed within a landing profile deposed in said conduit means.

20. A downhole hydraulic ram pump for lifting formation fluids out of a wellbore comprising:

a main body having a formation fluid inlet passageway through which formation fluids may flow, a lifted fluid outlet passageway through which lifted fluid may flow, and a spent formation fluid outlet through which spent fluid may flow; said formation fluid becomes said lifted fluid when said formation fluid is redirected through said lifted fluid outlet passageway, said formation fluid becomes said spent fluid when said formation fluid flows through said spent fluid outlet;

a conduit means having at least one formation fluid inlet means, providing a fluid passageway for conducting the formation fluid downward into said main body formation fluid inlet passageway;

a pressure chamber extending from said main body in said wellbore, separated by said lifted fluid outlet passageway, said lifted fluid outlet passageway receives said lifted fluid flow from said main body and pressure developed in said main body from suddenly stopping said spent fluid flow from said main body at said spent formation fluid outlet passageway, said lifted fluid and pressure pass said lifted fluid outlet passageway and are stored in said pressure chamber, said pressure chamber contains both fluid and gaseous substance, said pressure is stored by compressing said gaseous substance;

a normally closed valve means is mounted at said lifted fluid outlet passageway; said normally closed valve means prevents significant said lifted fluid flow from said pressure chamber to said main body;

a normally open valve means mounted within said main body at said spent formation fluid outlet passageway, said normally open valve means permits said spent fluid to flow out of said main body through said spent formation fluid outlet passageway, to a formation external of the pump, said normally open valve means closes when sufficient force is developed by passing said spent formation fluid flow, closure stops said waste fluid flow;

a tubing outlet means connecting to said pressure chamber, providing a fluid passageway through which said lifted fluid stored in said pressure chamber may flow into tubing to be lifted by the pressure stored in said pressure chamber to a higher elevation.

21. The downhole hydraulic ram pump of claim 20 wherein said pressure chamber comprising: said tubing and said pressure chamber both suspended from a wellhead, said tubing is spaced within said pressure chamber with there being an annular space formed therebetween;

said annular space is formed into an upper annular chamber and lower annular chamber by providing a sealing sub between said upper and lower annular chambers;

said upper annular chamber forms an annular collecting chamber for said gaseous substance;

said lower annular chamber forms said conduit means having at least one formation fluid inlet means, providing a fluid passageway for conducting said formation fluids downward into said main body formation fluid inlet passageway;

said sealing sub functionally divides said tubing into upper tubing and lower tubing;

said lower tubing provides a fluid passageway for conducting said lifted fluid upward from said main body, through said lifted fluid outlet, through said normally closed valve means, into said lower tubing;

said lower tubing conducts flow of lifted fluid into said upper tubing; and out through slotted tubing ports into said upper annular chamber;

said upper tubing provides a fluid passageway for conducting the lifted fluid upward from said upper annular chamber, through said slotted tubing ports, into said upper tubing commingling with said lifted fluid arriving from said lower tubing upward to a higher elevation or to an earth surface elevation.

22. A downhole hydraulic ram pump according to claim 21, whereas said wellhead provides at least one communication port to said upper annular chamber for removal or addition of said fluid and gaseous substance, for monitoring gas pressure, and for detecting fluid level.

23. A downhole hydraulic ram pump according to claim 20, whereas said conduit means has at least one sealing means providing a seal between said wellbore and said conduit means, having at least one landing profile means for receiving flow control devices and supporting tubing strings in said wellbore, said sealing means is anchored into said wellbore open hole.

24. A conduit means of claim 20, whereas said conduit means having at least one formation fluid inlet means that is controllable.

25. A hydraulic ram pump according to claim 20, whereas both said normally open valve means said normally closed valve means employ an adjustable spring to maintain said valve means in their normal positions, said valve means remain in their normal positions until overcome by fluid flow force.

26. A downhole hydraulic ram pump according to claim 20, whereas said normally open valve means employs an opposing slidable piston and cylinder means responsive to a pressure differential acting on both said normally open valve means and said opposing piston and cylinder means to approximately balance the valve closure forces;

said valve means and said opposing piston means are integral or threadedly joined having an axially aligned communication port;

said integral valve and piston employ an adjustable spring to bias said normally open valve in the open position.

27. A downhole hydraulic ram pump according to claim 20, whereas in lieu of said normally open valve means and said normally closed valve means, employ a wireline retrievable valve unit comprised of:

a normally closed valve means, a normally open valve means, and a wireline tool profile for running and pulling said wireline retrievable valve unit;

said wireline retrievable valve unit outer profile can be landed, sealed, and secured within said pressure chamber and said main body;

said wireline retrievable valve unit outer profile can be landed, sealed, and secured within an internal profile disposed within said pressure chamber and said main body formation fluid outlet;

having at least one side port for formation fluid flow to said wireline retrievable valve unit normally closed valve means, said side port aligned with a fluid passageway exterior of said pressure chamber and into said main body;

retrievable through said pressure chamber continuing upwards trough said tubing.

28. A wellbore completion design for installing in a subterranean fluid zone penetrated by an open hole wellbore comprising:

a casing structure extending from the surface to proximately the production fluid formation, to be pumped, having at least one side opening;

a first tubular structure positioned within the casing structure and continuing into the open hole; the first tubular structure comprising:

a hydraulic ram pump main body;

an anchoring and sealing device;

tubular sections spaced between the hydraulic ram pump main body and the anchoring and sealing device;

a ported tubular section;

a sealing device;

tubular sections spaced between the sealing device and the surface;

a second tubular structure positioned within the first tubular structure comprising:

a hydraulic ram pump landing sub;

a slidable sealing device for mating with the sealing device disposed within the first tubular structure;

tubular sections spaced between the hydraulic ram pump landing sub and the slidable sealing device;

a ported tubular section;

tubular sections spaced between the ported tubular section and the surface;

a casing head;

a wellhead;

a hydraulic ram pump wireline retrievable valve unit comprising:

a normally closed check valve;

a normally open impulse valve and;

an internal wireline tool profile for running and pulling the wireline retrievable valve unit.

29. The method for completing of claim 28, whereas said casing structure extends to the full depth of the wellbore.

30. An installation method for claim 28, whereas a subterranean fluid zone penetrated by a open hole wellbore, having a downhole hydraulic ram pump disposed therein for pumping formation fluids from the wellbore comprising the steps of:

positioning a casing structure having more than one side opening in the wellbore, from the surface to proximately the production fluid formation, to be pumped, such that side opening is aligned with the production fluid formation, and the production fluid flow is into the casing structure;

positioning the casing structure to extend past the production fluid formation one or two sections of casing in order to receive an anchoring and sealing device and for cementing in place below the production fluid formation, the casing structure provides porting enabling communication external to the casing structure during cementing;

flowing cementitious material down the casing and out the porting externally about the casing structure, clearing the internal casing structure of cementitious material, forming a seal and anchoring means between the open hole wellbore and the casing structure, holding the production fluid formation clear of cementitious material;

positioning a first tubular structure within the casing structure, the end of first tubular structure continuing into the open hole until arriving near the production fluid receiving formation and above the receiving formation liquid level encountered;

setting the anchoring and sealing device within the casing structure, fixing the position of the first tubular structure relative to the casing structure and sealingly engaging below the casing structure side opening, and above the casing structure lower end within the casing structure, so that production fluid flow is prevented between the casing structure and first tubular structure below the anchoring and sealing device;

positioning the ported tubular section, within the casing structure, aligning the tubular section ports with the casing structure side opening, where production fluid flow is into the first tubular structure;

positioning a second tubular structure within the first tubular structure;

connecting a hydraulic ram pump landing sub, an element of the pump with an internal profile enabled to receive a hydraulic ram pump wireline retrievable valve unit, to the end of the second tubular structure and inserting the landing sub device, sealingly engaged, within the hydraulic ram pump main body disposed within the first tubular structure;

spacing tubular sections between the hydraulic ram pump landing sub and a slidable sealing device;

positioning a slidable sealing device for mating with the sealing device disposed within the first tubular structure, positioning the slidable sealing device disposed within the second tubular structure within its mating and sealing device, sealingly engaged, whereas the slidable sealing device is enabled to move downward within the sealing device, lowering the second tubular structure, while remaining sealingly engaged;

connecting a ported tubular section to the upper end of the slidable sealing device disposed within the second tubular structure;

spacing tubular sections between the ported tubular section and the surface;

installing a casing head at the surface onto the casing structure and mounting a wellhead on the casing head;

suspending the first tubing structure from the wellhead, supporting the weight of the first tubing structure by both the wellhead and the anchoring and sealing device;

spacing and suspending the second tubing structure from the wellhead ensuring the landing sub remains engaged within the hydraulic ram pump main body, not damaging the bearing surfaces between the landing sub and the main body, and the second tubing structure remains relatively straight within the first tubing structure;

running by wireline and installing a hydraulic ram pump wireline retrievable valve unit in the landing sub and the hydraulic ram pump main body.

31. A method for pumping fluid being both liquid and gas, from a wellbore being an open hole, penetrating a subterranean fluid zone formation comprising the steps of:

determining the location in a subterranean fluid zone, a substantially liquid bearing formation to be pumped and the presence of at least one lower formation capable of receiving the liquid flow from upper said substantially liquid bearing formation;

suspending a first tubular string within the wellbore being an open hole, and a second tubing string within the first tubing string, both suspended from a surface device spanning said open hole, providing a fluid communication path through the first tubing string wall aligned with said substantially liquid bearing formation, whereas substantially liquid bearing formation fluid flows down an annulus formed between the first tubing string and the second tubing string, surrounding the second tubing string;

setting at least one packer disposed within the first tubing string, within the open hole below said substantially liquid bearing formation and sealingly against the open hole wall, said packer having at least one passageway extending through said packer to continue fluid communication down said annulus;

connecting a downhole hydraulic ram pump to the end of said first tubing string in said wellbore proximate said lower receiving formation, whereas connecting said downhole hydraulic ram pump threadedly or by installing said downhole hydraulic ram pump by wireline methods or running said downhole hydraulic ram pump attached to tubing, thereby lowering said pump into said first tubing string landing, locking, and sealing said downhole hydraulic ram pump in place;

operating said downhole hydraulic ram pump, providing a fluid communication path through said downhole hydraulic ram pump, thereby exiting said substantially liquid formation fluid from said downhole hydraulic ram pump intermittently as waste fluid, farther providing fluid communication with said lower receiving formation exterior of said downhole hydraulic ram pump;

redirecting said substantially liquid formation fluid within said downhole hydraulic ram pump, intermittently ramming said substantially liquid formation fluid into said second tubing string;

positioning said second tubing string within said first tubular string, connecting said second tubing string and said downhole hydraulic ram pump, whereas fluid communication for the substantially liquid formation fluid from said downhole hydraulic ram pump continuing through said second tubing string upward in the direction of the earth's surface:

setting a second sealing device disposed within the second tubing string, within the first tubing string above upper said substantially liquid bearing formation sealingly inside said first tubing string dividing said annulus into an upper and lower annulus, said lower annulus continuing to provide a fluid communication path downwardly to said downhole hydraulic ram pump, said upper annulus being capped by said surface device forming a large annulus chamber;

providing a fluid communication path through the second tubing string wall above said second sealing device, whereas said substantially liquid formation fluid may communicate with said upper annulus, collecting the gaseous component from said substantially liquid formation fluid;

responding to the downward flow of said substantially liquid formation fluid within said lower annulus, said downhole hydraulic ram pump suddenly interrupts said waste fluid flow from said downhole hydraulic ram pump creating a condition of fluid compression for a fraction of a second within said lower annulus and said downhole hydraulic ram pump;

compressing said substantially liquid formation fluid within said lower annulus and said downhole hydraulic ram pump, rams said substantially liquid formation fluid into said second tubing string thereby compressing said gaseous substance collected in said upper annulus and said substantially liquid formation fluid contained in said second tubing string, said substantially liquid formation fluid and said gaseous substance being compressed push said substantially liquid formation fluid within said second tubing string upward to the surface thereby lessening said fluid compression condition, therefore pumping fluid being both liquid and gas, from a wellbore being an open hole, penetrating a subterranean fluid zone formation.

32. The system of claim 31, further comprising: a packer disposed within said first tubular string; wherein a packer is sealingly engaged below said substantially liquid formation, and above said lower receiving formation.

* * * * *